US005137676A

United States Patent [19]

Chiou

[11] Patent Number: 5,137,676

[45] Date of Patent: Aug. 11, 1992

[54] PROCESS FOR INCREASING THE HANDLING CONTROL OF A BUNDLE OF WET YARNS

[75] Inventor: Minshon J. Chiou, Richmond, Va.

[73] Assignee: E. I. du Pont de Nemours and Company, Wilmington, Del.

[21] Appl. No.: 596,982

[22] Filed: Oct. 10, 1990

[51] Int. Cl.[5] ..... D01D 11/00

[52] U.S. Cl. ..... 264/210.8; 264/290.5; 264/290.7

[58] Field of Search ..... 264/210.8, 290.7, 103, 264/290.5

[56] References Cited

U.S. PATENT DOCUMENTS

| | | | |
|---|---|---|---|
| 2,289,232 | 7/1942 | Babcock | 264/290.7 |
| 2,581,922 | 1/1952 | Spencer | 264/290.7 |
| 3,574,811 | 4/1971 | Jamison | 264/290.7 |
| 4,056,240 | 11/1977 | Gallini et al. | 242/47.09 |
| 4,466,935 | 8/1984 | Bair et al. | 264/184 |

*Primary Examiner*—Hubert C. Lorin

[57] ABSTRACT

A process is disclosed for improving the handling control of a moving, wet, unitary bundle of a plurality of yarns wherein a tension is applied to the yarn between the spinneret and the feed rolls until individual yarns can be separated from the bundle and, then, the tension is removed and the separation is maintained.

4 Claims, 2 Drawing Sheets

PROCESS FOR INCREASING THE HANDLING CONTROL OF A BUNDLE OF WET YARNS

BACKGROUND OF THE INVENTION

1. Field of the Invention

This invention relates to a process for improving the ease of separation of individual yarns from a wet yarn bundle during start-up of a process to manufacture the yarns and transport the yarns from spinning stations to washing and drying stations.

2. Description of the Prior Art

U.S. Pat. No. 4,466,935 issued Aug. 21, 1984 on the application of Bair and Gulrich, discloses the continuous use of snubbing pins applied between the coagulating bath and the wash rolls to increase the yarn tension to establish conditions required for manufacturing fibers having particular characteristics. The snubbing pins used in that patent are used continuously throughout the fiber manufacturing process for applying tension necessary to achieve the product characteristics, not specially for commencement of the spinning process, itself.

U.S. Pat. No. 4,056,240 issued Nov. 1, 1977 on the application of Gallini et al., discloses a yarn separation guide roll useful for separating and stabilizing yarns to be wrapped over forwarding rolls for treatment of the yarns.

SUMMARY OF THE INVENTION

The present invention provides a process for increasing the handling control of a moving bundle of a plurality of wet yarns, on the fly, comprising the steps of: establishing a moving, wet, unitary bundle of a plurality of yarns under a tension of less than 0.6 grams per denier for low tension treatment of the yarns on rolls; attaching a tensioning means to the moving bundle before the rolls to increase the tension on the yarns before and after the rolls to more than 0.6 grams per denier and less than the breaking force; introducing the moving bundle, under increased tension, to a yarn separation guide; separating the bundle into individual yarns; and removing the tensioning means. There is specific provision for separating a bundle of a plurality of wet yarns, on the fly, into individual yarns at the commencement of the spinning process, as a start-up operation.

DETAILED DESCRIPTION OF THE INVENTION

In the spinning manufacture of fibers, there is often a desire to maintain very low tensions on the fibers during treatment with liquids and in the drying stages. These low tensions have an effect on the fiber properties and the associated end-use performance of the fibers, in that fibers made using such low tensions may exhibit increased elongation at break and increased toughness and associated properties.

The fibers may be spun in the form of multi-filament yarns and the yarns, removed from their coagulation bath, may be bundled and introduced to additional liquid treatment processes. Very low tension on the wet yarn bundle renders control of the bundle and the individual yarns in the bundle very difficult. For example, it is often desirable to separate the bundle into its individual yarns for the purpose of washing and other liquid-treating. When the bundle is under very low tension, the yarns are very difficult to separate; and it has been discovered that a slight increase in tension on the yarns yields a large increase in control over separating the individual yarns from the wet yarn bundle. Of course, any increase in tension to gain control over the yarns causes a loss in the yarn qualities which made the low tension desirable in the first place. It is desirable to set the process conditions and then start up the process without changing those conditions.

The present invention resides in the discovery that yarns can be separated from the yarn bundle, even though the low tension process conditions have been set already, by applying a temporary increase in tension on the yarn bundle using a tensioning device upstream from the location where the yarn separation will take place. It has, also, been discovered that, once separated, the tension can be reduced to the desired low level without losing the yarn separation. This temporary increase in tension upstream from the location of yarn separation can be accomplished without changing the other process conditions and can, after yarn separation is completed, be removed without upsetting the already established process in any way. Quite surprisingly, it has been discovered that an increase in the threadline tension produces an increase in threadline tension downstream even though the threadline may pass over several driven rolls in the meantime. It is this discovery of translated tension which permits operation of the present invention.

Figure 1:
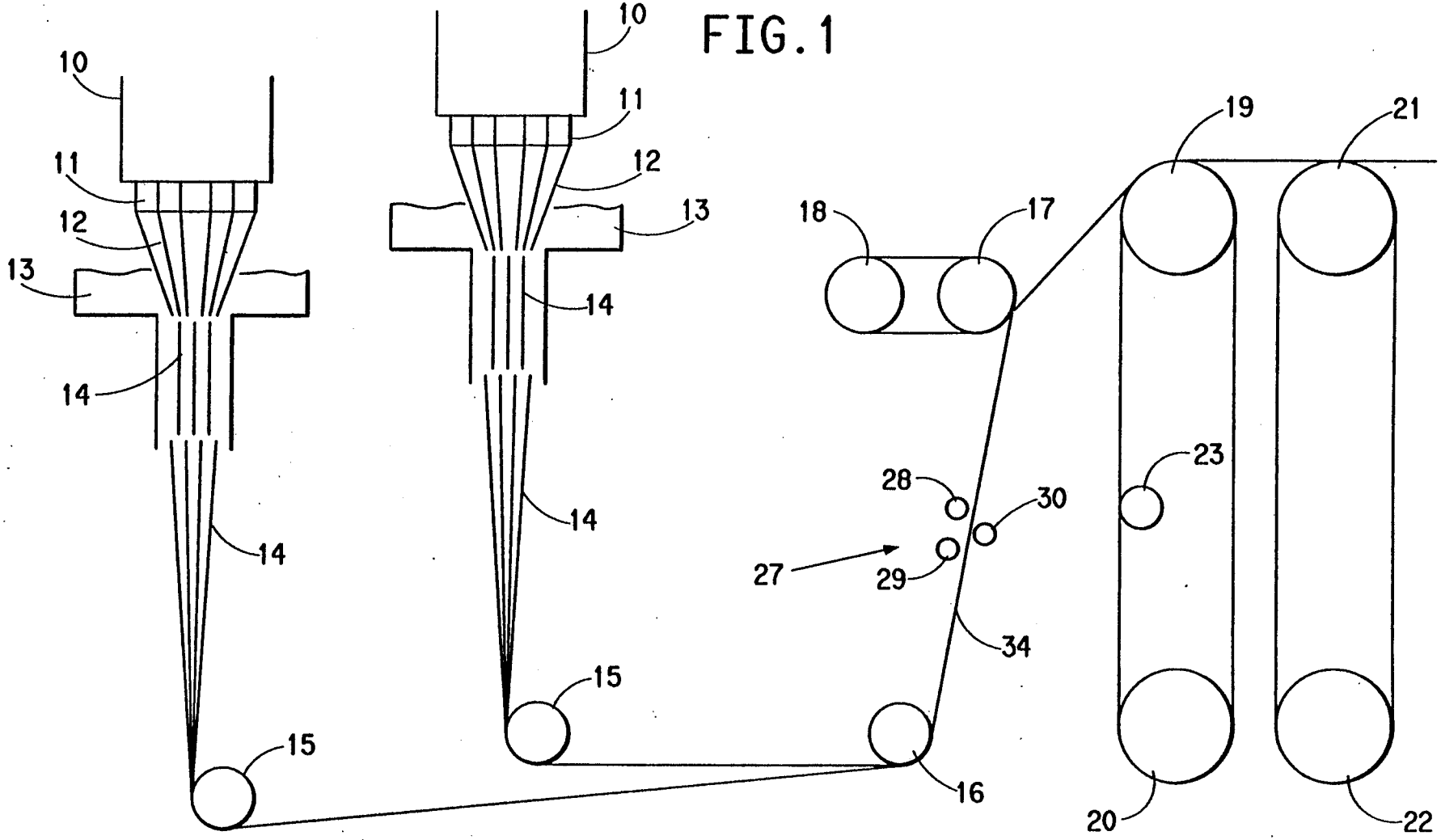
FIG. 1 is a schematic representation of a system in which the process of this invention may be used.

FIG. 1 is a general, schematic, diagram of a spinning process in which the technique of this invention finds use. Spinning dope is spun from spinning stations including vessel 10, through spinneret 11 and air gap 12 and into a coagulation bath 13 to become a part of yarn 14. The invention contemplates the presence of several spinning stations, each contributing to make up yarns 14 which are combined immediately thereafter into yarn bundles 34. Yarn bundle 34 may include many individual yarns 14; and it often desired that those individual yarns should be separated for further fiber processing steps. Yarns 14 pass around direction change rolls 15 and 16 and then, as yarn bundle 34, on to feed rolls 17 and 18. At least one of feed rolls 17 and 18 is driven and the feed rolls serve to draw the yarns 14 of bundle 34 from spinnerets 11 and through coagulation baths 13. From the feed rolls, the yarn bundle proceeds to treatment rolls, such as, for instance, wash rolls 19 and 20 and neutralizing rolls 21 and 22; and the bundle is separated into individual yarns to make multiple wraps on those treatment rolls.

The bundle is separated into individual yarns by means of a yarn separation guide 23, such as has been described in U.S. Pat. No. 4,056,420, incorporated herein by reference. The individual yarns are generally each wrapped several times around the treatment rolls and the yarn separation guide serves to place the yarns on the treatment rolls and to stabilize the yarns in their proper location while the temporary tension of this invention is applied. Once the yarns are positioned and stabilized, the tension can be removed and the position and the stability of the yarns is, nevertheless, maintained.

Tensioning means useful in practice of this invention can be any of the well-known arrangements of snubbing pins which have been used in the past for increasing the tension in a moving threadline. For practice of this invention, such a tensioning means 27 can be placed in the threadline to temporarily increase the threadline tension in order to facilitate separation of individual yarns before washing the fibers or treating them further with other liquids. The tensioning means 27 which is shown includes three pins. Fixed pins 28 and 29 are located adjacent to the threadline and movable pin 30 is placed on the opposite side of the threadline between pins 28 and 29. To increase the threadline tension, movable pin 30 is moved toward and between fixed pins 28 and 29 to engage the threadline and increase the force needed to move the threadline through and past the tensioning means. It has been discovered that tensioning means 27 can be positioned at any location in the threadline up to the point where the yarn bundle is to be separated. Quite surprisingly, it has been discovered that, if tension is increased by tensioning means 27 before driven feed roll 17 or 18, the increase in tension will continue through later rolls 19 to 22 and beyond, even though some of those rolls are driven.

By using the present invention, a moving bundle of wet yarns can be established and conditions can be set for the desired low threadline tensions in that bundle before the yarn bundle is separated; and, then, yarn separation can be accomplished by means of increased threadline tension as far upstream as desired from the location where that yarn separation is required.

Figure 2:
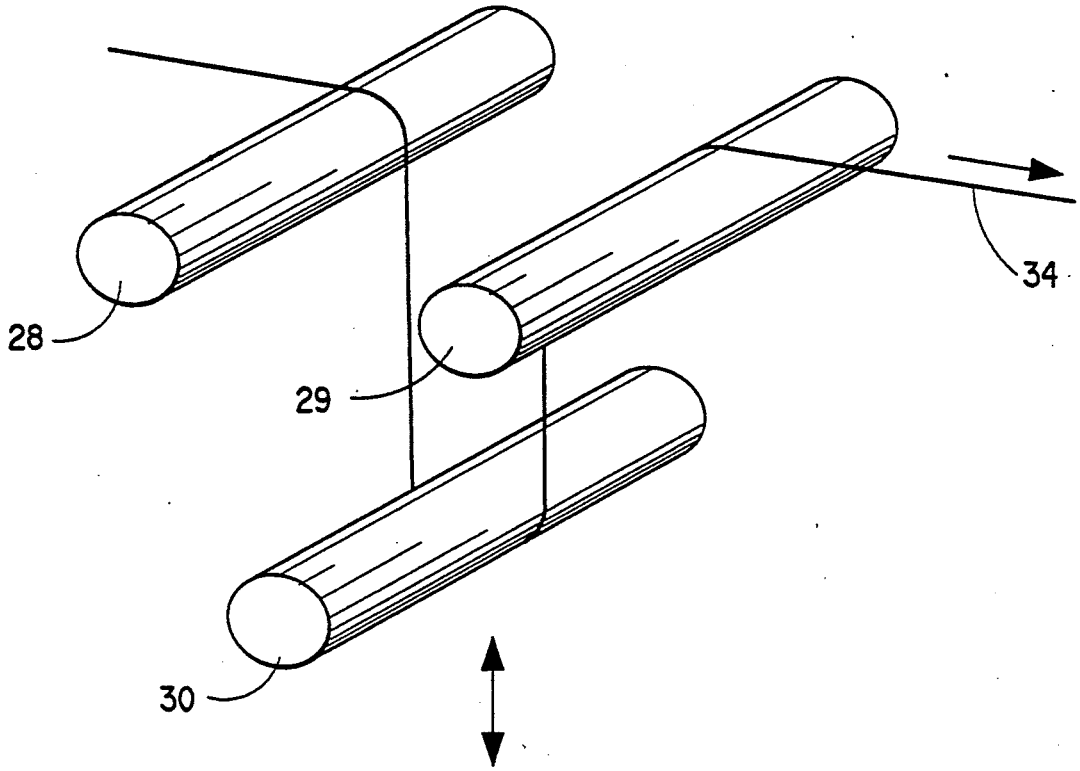
FIGS. 2 and 3 are representations of various tensioning means which can be used in practice of this invention.
Figure 3:
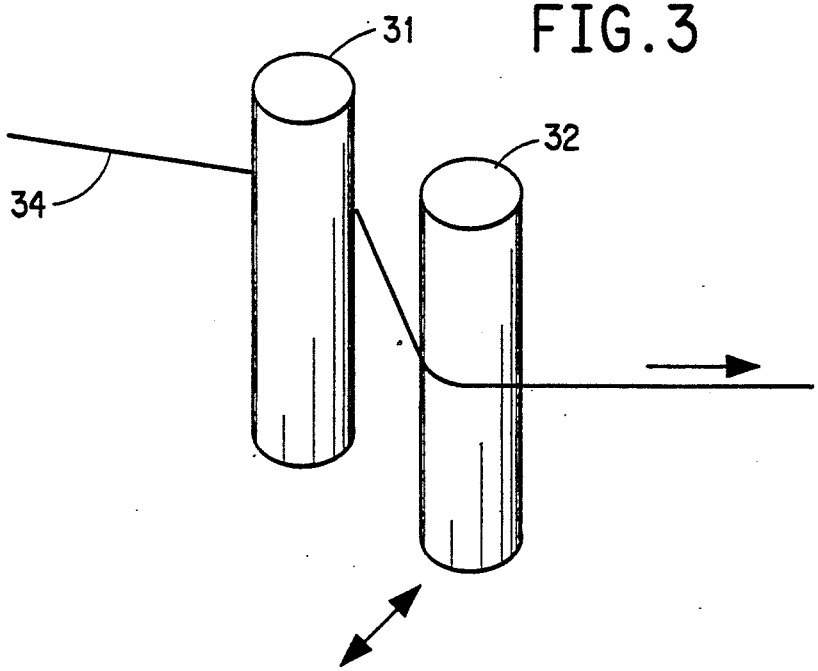

FIGS. 2 and 3 represent other tensioning means useful in the practice of this invention. Of course, any other configuration of pins or rollers or other tensioning means can be used so long as they can be engaged with and disengaged from the threadline on the fly. The device of FIG. 2 is the same as that shown in FIG. 1. Pins 28 and 29 are fixed and pin 30 is movable against yarn bundle 34. The device of FIG. 3 utilizes only two pins. Pin 31 is fixed and pin 32 is movable to engage yarn bundle 34.

DESCRIPTION OF THE PREFERRED EMBODIMENTS

EXAMPLES I-IV

These examples were conducted by addition of a tensioning means to an existing fiber spinning machine similar to that shown in FIG. 1, to demonstrate the improvement in process start-up using the technique of this invention.

The existing spinning machine was similar to that shown in FIG. 1 and included spinning stations followed by a coagulation bath, after which the spun yarn bundle passed a pair of feed rolls which was used to draw the yarn bundle from the spinning stations and through the coagulation bath. After the feed rolls, there were pairs of rolls for washing and neutralizing the yarn; and the yarn bundle was drawn further through the process by having one driven roll in each pair of washing and neutralizing rolls. The yarn bundle included two yarn threadlines twined together during the start-up; and each threadline was 1500 denier. The spinning speed was 300 yards per minute.

The tensioning means was positioned after the spinneret and before the feed rolls. The tensioning device was made of three ceramic bars, two of which were fixed adjacent to, and on the same side of, the line of the yarn bundle, and the third of which was located on the opposite side of the yarn bundle, between the first two, and was movable. To cause tension on the yarn bundle, the movable bar was moved into contact with the yarn bundle to force the yarn bundle against the fixed bars. The tension on the yarn bundle was increased by moving the movable bar further into the yarn bundle to increase the angles through which the yarn bundle passed in the tensioning means.

To initiate the start-up, the spinning was started, the yarn bundle was conducted from the spinneret and through the coagulation bath, the feed rolls, the wash rolls, and so on through the spinning machine. The desired operating yarn tension was established before any attempted separation of the yarns. The tensioning means was not engaged while the desired operating yarn tension was established. Once the spinning conditions were established at the operating tensions required for the particular fiber products desired, the temporary tensioning means was engaged to facilitate separation of the individual yarn threadlines. Separation of the yarn bundle into individual yarn threadlines on the washing and neutralizing rolls was facilitated by engaging the temporary tensioning means of this invention between the spinnerets and the feed rolls, and introducing the tensioned bundle to a yarn separation guide. Once the threadlines were separated, the tensioning means was disengaged and separation of the threadlines was maintained. Ease of threadline separation with the temporary tensioning means was compared with ease of threadline separation without the tensioning means at several levels of spinning machine tension. The results of the test are in the Table, below. Tensions are given in grams per denier. In these Examples, the tension between the Feed Rolls and the Washing Rolls and the tension between the Washing Rolls and the Neutralizing Rolls were very low, before engagement of the tensioning means. After engagement of the tensioning means, the tension between the Feed Rolls and the Washing Rolls and the tension between the Washing Rolls and the Neutralizing Rolls were substantially increased despite the fact that one of the Washing Rolls and one of the Neutralizing Rolls were driven. The increased tension was the reason for facilitated yarn separation.

It will be noted that the technique of the invention provides the greatest benefits in start-up of the machine under spinning conditions which require low running tensions.

TABLE

| Example No. | Device Used? | Tension (gpd) FR - WR | Tension (gpd) WR - NR | Ease of Separation |
|---|---|---|---|---|
| I | yes | 0.80 | 1.07 | Easy |
| Control | no | 0.23 | 0.33 | Very Difficult |
| II | yes | 0.83 | 0.83 | Easy |
| Control | no | 0.40 | 0.40 | Very Difficult |
| III | yes | 1.10 | 1.17 | Easy |
| Control | no | 0.57 | 0.70 | Difficult |
| IV | yes | 1.93 | 1.33 | Easy |
| Control | no | 0.80 | 0.60 | Easy |

NOTE
FR = Feed Roll; WR = Washing Roll; NR = Neutralizing Roll

Note that the ease of separation of the yarn bundle is a function of tension on the threadlines and that the benefit of this invention is realized for conditions wherein the desired spinning machine tensions are lower than the tension at which the yarn bundle is easily separated.

I claim:

1. A process for increasing the handling control of a bundle of a plurality of wet yarns, on the fly, comprising the steps of:

a) establishing a moving, wet, unitary bundle of a plurality of yarns under a tension of less than 0.6 grams per denier;

b) attaching a tensioning means to the moving bundle to increase the tension to more than 0.6 grams per denier and less than the breaking force of the bundle;

c) introducing the moving bundle under increased tension to a yarn separation guide;

d) separating the yarn bundle into individual yarns; and e) removing the tensioning means.

2. The process of claim 1 wherein the tensioning means comprises an arrangement of three snubbing pins, two of which are fixed and located adjacent to the moving bundle and the third of which is movable and is placed on the opposite side of the moving bundle between the two fixed pins.

3. The process of claim 1 conducted on a spinning machine.

4. The process of claim 1 conducted on a spinning machine wherein the yarns are pulled from spinnerets on the spinning machine by a feed roll upstream from the tensioning means.

* * * * *